United States Patent [19]

Richter

[11] Patent Number: 4,843,773

[45] Date of Patent: Jul. 4, 1989

[54] MOUNTING OF GLAZING PANELS

[75] Inventor: Donald L. Richter, Rolling Hills Estate, Calif.

[73] Assignee: Temcor, Torrance, Calif.

[21] Appl. No.: 174,708

[22] Filed: Mar. 29, 1988

Related U.S. Application Data

[63] Continuation-in-part of Ser. No. 128,871, Dec. 4, 1987.

[51] Int. Cl.[4] ..... E04B 1/62

[52] U.S. Cl. ..... 54/397; 52/398; 52/774; 52/489; 52/741

[58] Field of Search ..... 52/397, 398, 399, 773, 52/774, 489

[56] References Cited

U.S. PATENT DOCUMENTS

| | | | |
|---|---|---|---|
| Re. 25,030 | 8/1961 | Owen | 52/772 |
| 919,887 | 4/1909 | Kohler | 52/774 |
| 2,123,093 | 7/1938 | Bowman | 52/398 |
| 2,400,421 | 5/1946 | Johnson . | |
| 2,604,061 | 7/1952 | Estey . | |
| 2,856,650 | 10/1958 | Hildebrand | 52/788 |
| 3,238,685 | 3/1966 | Emory | 52/774 |
| 3,694,984 | 10/1972 | Schwartz | 52/398 |
| 3,909,994 | 10/1975 | Richter | 52/63 |
| 3,916,589 | 11/1975 | Richter | 52/81 |
| 3,918,226 | 11/1975 | Naidus | 52/232 |
| 3,919,813 | 11/1975 | Beindorf | 52/80 |

FOREIGN PATENT DOCUMENTS

| | | | |
|---|---|---|---|
| 511382 | 8/1939 | United Kingdom | 52/773 |

*Primary Examiner*—Carl D. Friedman

*Attorney, Agent, or Firm*—Christie, Parker & Hale

[57] ABSTRACT

Glazing panels are mounted to a support member to have a substantially flush surface between the panels. Each panel carries on an inner surface along each mounting edge a member defining an elongate recess open away from a central part of the sheet. A central upstanding rib on the support member forms shoulders therealong which face toward the member. A resilient gasket extends along the support member on either side of the central rib. Each panel is placed in its desired mounted position with its mounting edge member in contact with the adjacent gasket so that the edge of the sheet is spaced to the side of the central rib which ends between the sheet outer surface and the support member. Resilient clips are engaged at intervals along each sheet between the sheet's recess and the corresponding shoulder to pull the sheet into sealing contact with its gasket via its mounting edge member. A sealing material is applied between the adjacent sheet edges, substantially flush with the outer surfaces of the sheet, over a backer which is bridged between the opposing recesses over the central rib.

30 Claims, 3 Drawing Sheets

MOUNTING OF GLAZING PANELS

CROSS-REFERENCE TO RELATED APPLICATIONS

This application is a continuation-in-part of copending application Ser. No. 07/128,871 filed Dec. 4, 1987 still pending 11-16-88.

FIELD OF THE INVENTION

This invention pertains to the mounting of glazing panels, such as transparent panels, to supporting frames. More particularly, it pertains to structures and procedures for mounting glass or transparent plastic panels in skylights, domes and other space-enclosing structures.

BACKGROUND OF THE INVENTION

The copending application identified above pertains to improvements in domes and similar structures useful for enclosing or covering a desired space. Such domes can be used as the principal aspect of a space-enclosing structure, or they can be used as components of a larger structure. Such domes can be transparent and, in such form, can be used to enclose botanical gardens, as aviaries, and as skylights, among other uses.

Where domes according to the copending application, or according to other design philosophies, are provided as transparent space enclosures, a need exists for efficient and effective ways to mount transparent glass or plastic panels to the dome framework, which usually is defined as an open metal framework skinned or closed by the transparent panels. An effective mounting arrangement should hold the panels in place in a weathertight manner and in a mechanically secure manner so that the mounting does not leak and the panels cannot come loose in unintended ways. An effective mounting also should be accommodating of differences in thermal coefficients of expansion of the elements being interconnected. An efficient mounting arrangement should be quick, easy and safe to use and involve uncomplicated structures and procedures. An efficient mounting arrangement also should have long life and minimum maintenance requirements.

My prior U.S. Pat. Nos. 3,909,994 and 3,916,589 illustrate and describe arrangements for mounting glazing panels to supporting members. Those arrangements are effective and efficient according to the criteria reviewed above. However, they both involve structures which project outwardly of the mounted glazing panels. Those projections provide edges along which dust and the like can collect so that, when rain falls on the exterior of the assembled mounting, streaks can be produced across the outer surface of the structure. Such streaks are aesthetically undesirable; their elimination requires periodic washing of the structure, and that requirement detracts from long-term economic efficiency of the mounting.

SUMMARY OF THE INVENTION

This invention provides an effective and efficient structural arrangement, and also a procedure, for mounting glazing panels to supporting members in a secure and weathertight joint. The structure of the completed joint provides a flush surface between the outer surface of adjacent panels mounted to a common support member, thereby providing a mounting which does not readily accumulate dust and the like, which can produce streaks due to rain. The presently preferred utility of the mounting arrangement is in a transparent dome of the kind described and illustrated in the copending application identified above. However, the mounting arrangement is useful in mounting glazing panels and other kinds of sheets in other kinds of domes and in structures other than domes, such as office buildings having glass or other curtain walls.

Generally speaking, in terms of structure, this invention provides a joint for connecting an edge margin of a sheet of material to a support member which has a top surface. The joint comprises means along an edge margin of the sheet and which define at least at each of several intervals along the sheet edge a recess disposed substantially parallel to the adjacent edge of an outer surface of the sheet. Such means are located on the sheet other than along a margin of the sheet outer surface, so that the outer surface extends to the sheet edge. The recess faces laterally away from a central part of the sheet. The joint also includes means upstanding from the support member top surface defining downwardly facing shoulder means above the top surface of the support member. The shoulder means are provided at least at intervals along the support member adjacent a desired position in which the sheet is to be mounted. Resilient gasket means are carried by the support member top surface along the length of the member at a location on the member within the desired position of the sheet as mounted to the support member. The joint also includes resilient clip means. The clip means are configured at one end thereof to forcibly engage in the recess. The clip means are configured at the other end to forcibly engage the shoulder means. Intermediate their ends, the clip means are dimensioned and configured adequately that, upon placement of the sheet in the desired position, and upon engagement of the clip means with the recess and shoulder means, the clip means forcibly urges the sheet into sealing contact with the gasket means and holds the sheet in the desired position.

DESCRIPTION OF THE DRAWINGS

The above-mentioned and other features of this invention are more fully set forth in the following description of the presently preferred other embodiments of the invention which description is presented with reference to the accompanying drawings, wherein:

FIG. 7 is a fragmentary elevation view, partly in cross-section, taken from a side of a support member, showing an embodiment of the invention using discontinuous recesses and projections between respective ones of which individual clips are engaged for holding a glazing panel on the support member.

DESCRIPTION OF THE ILLUSTRATED EMBODIMENTS

Figure 1:
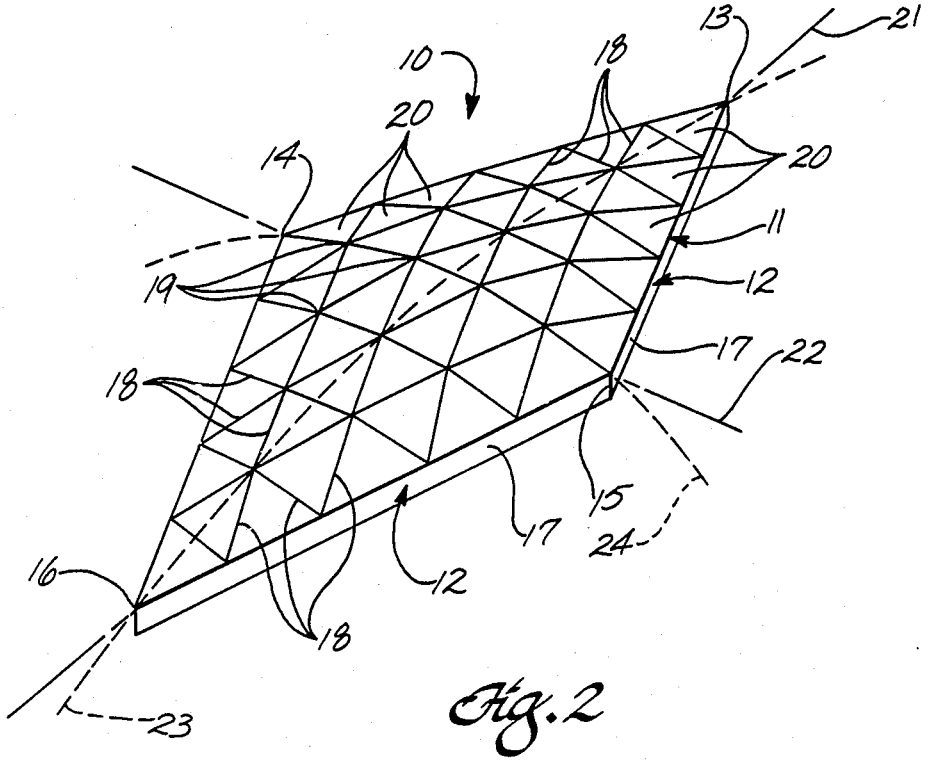
FIG. 1 is a perspective view of a dome module which provides the presently preferred environment for use of this invention.

FIG. 1 shows a module 10 of a dome according to the design philosophy described in the copending application identified above. According to that philosophy, a plurality of modules 10 are interconnected along their edges to define the overall dome structure. Dome module 10 is an essentially rigid construction having a perimetral frame 11 composed of four structural edge members 12 interconnected to define a generally rhomboidly-shaped perimeter of the module when the module is viewed directly from above. Frame edge members 12 are interconnected to each other at corners 13–16 of the module. Each edge member 12 has a flat outer surface 17 via which the module is connected to a frame edge member of an adjacent module in the overall dome. The diamond-shaped area bounded by module frame 11 is crossed by a plurality of secondary structural members 18 which are arranged to triangulate the space within the frame. Accordingly, the secondary structural members, which preferably are straight, intersect and are connected to each other at a plurality of hub points 19 within the perimeter of the module. The secondary structural members are arranged to define between them, and in cooperation with frame 11, a plurality of preferably planar triangular openings, each of which is closed by a respective closure panel 20; the closure panels preferably are transparent.

Figure 3:
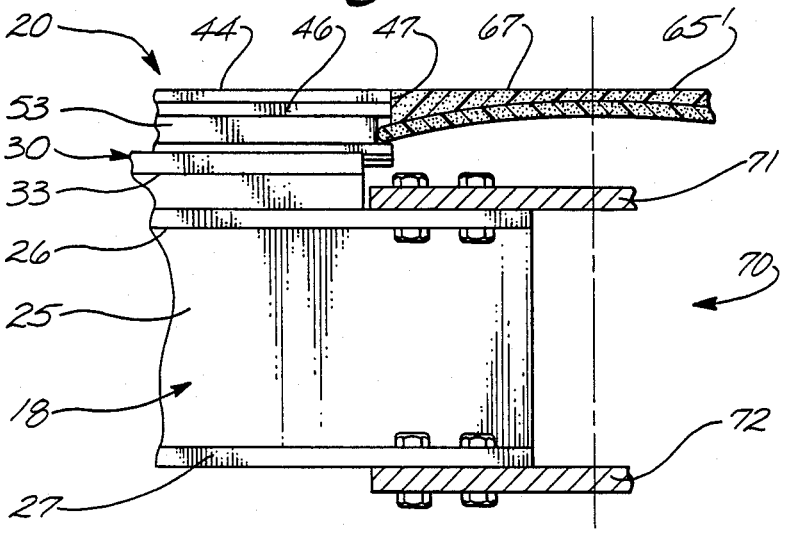
FIG. 3 is a fragmentary cross-sectional elevation view through a hub provided for interconnecting plural support members at adjacent corners of a plurality of openings, each of which is closed by a corresponding sheet member.
Figure 5:
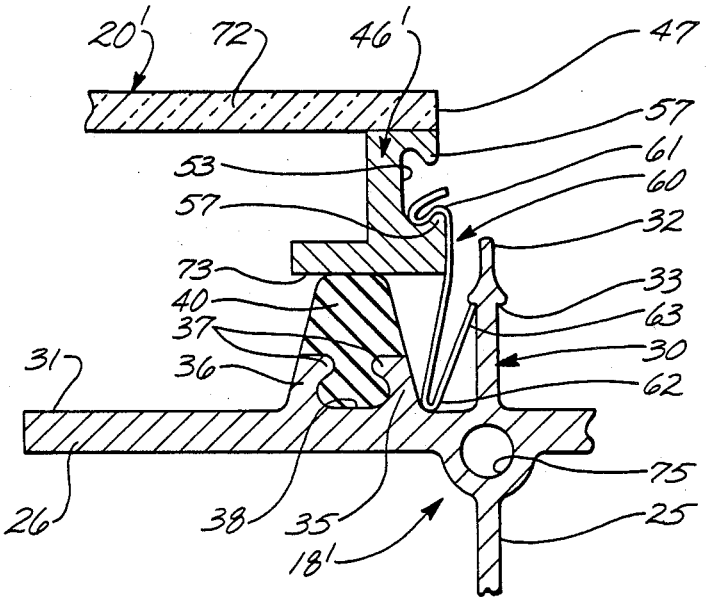
FIG. 5 is a cross-sectional elevation view, similar to FIG. 2, showing the application of this invention to a single glazed panel in the context of another form of support member usable with a hub assembly of the kind shown in my prior U.S. Pat. No. 3,916,589.

The interconnections between secondary structural members 18 at hub points 19 can be structurally defined in any desired and effective way, such as by use of the hub arrangements shown in FIGS. 3 and 5 of my prior U.S. Pat. No. 3,909,994, or those shown in my U.S. Pat. 3,916,589 (see especially FIGS. 5–8 and 13).

As shown in FIG. 1, dome module 10 has a major diagonal 21 which extends between corners 13 and 16, and a minor diagonal 22 which extends between corners 14 and 15 of frame 11. The four corners of the frame need not be disposed in a common plane, but can lie in a surface which is concave downwardly of the module, the module being shown in FIG. 1 in perspective from a vantage point above the module. Also, as shown in FIG. 1, the outer surface of the module, as defined by the network of secondary structural members 18 and closure panels 20, is not flat, but is curved convex upwardly of the module. Such curvature preferably is a compound curvature in which the module outer surface generally conforms to a major curvature represented by line 23 associated with the module's major diagonal 21 and a minor curvature 24 associated with the module's minor diagonal 22.

Figure 2:
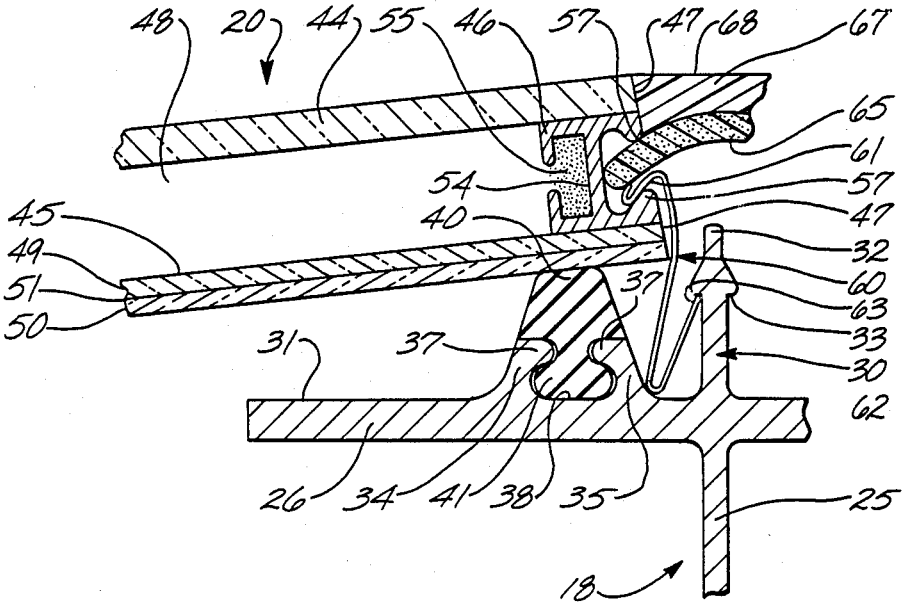
FIG. 2 is a fragmentary cross-sectional elevation view of the presently preferred joint of this invention, such view being taken through the joint at a location intermediate the length of a support member and of a sheet mounted to the support member.
Figure 4:
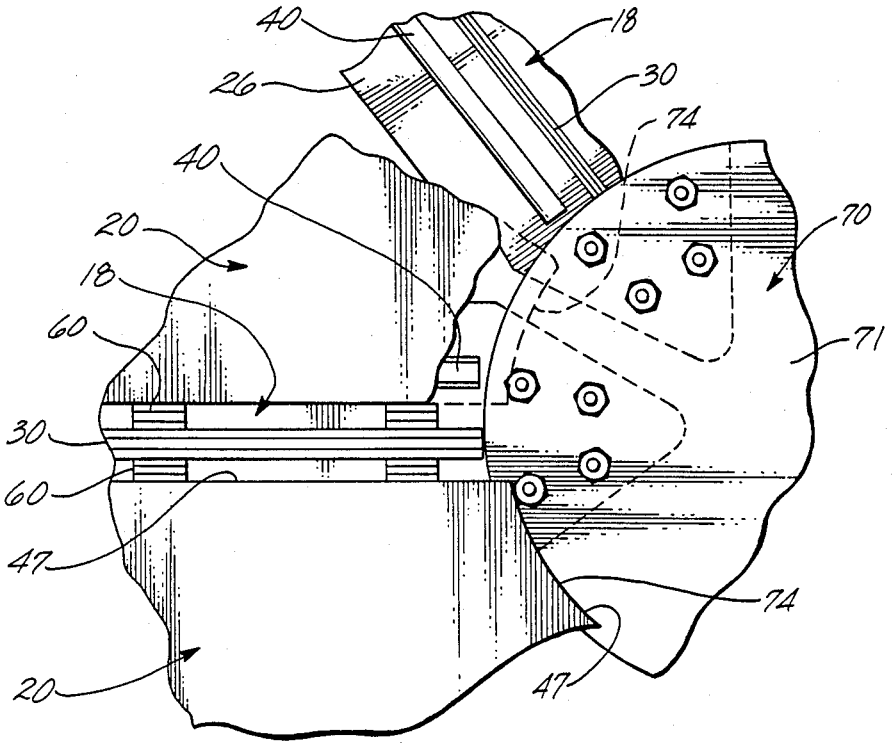
FIG. 4 is a fragmentary top plan view, with certain parts deleted, of the structure shown in FIG. 3

Dome module 10 provides the presently preferred environment and context of use of the improved joint provided by this invention, which joint is shown in greater detail in its presently preferred form in FIGS. 2–4.

Each secondary structural member 18 in module 10 serves as a support member for supporting one or two of the preferably transparent closure panels 20 of the module. FIGS. 2 and 3 show that each such support member preferably is provided with a cross-sectional configuration generally conforming to that of an I beam. Accordingly, each support member 18 has a central web 25 which extends perpendicularly between an upper flange 26 and a lower flange 27 midway of the width of each of those flanges.

An upstanding rib 30 is carried by the upper surface 31 of the top flange of support member 18. The rib preferably is coplanar with web 25 and extends above the top flange to an upper end 32. A short distance below its upper end, the opposite side surfaces of the rib are bulbed outwardly to define a pair of downwardly facing shoulders 33 which are disposed one on each side of the rib. The rib extends essentially entirely along the length of support member 18, and the shoulders are defined along the entire length of the rib. The shoulders preferably are located nearer to rib upper end 32 than they are to flange top surface 31.

A pair of shallow ribs 35 and 36 are carried on flange top surface 31 on either side of rib 32. That is, there is a set of ribs 35, 36 on one side of the central rib 30 and a similar set of such ribs on the other side of the central rib, so that rib 30 is centrally disposed between the two shallow rib sets. Ribs 35 and 36 in each set are referred to as inner and outer ribs, respectively, in view of their positions relative to central rib 30. Ribs 35 and 36 preferably have their upper extents disposed in a common plane which preferably lies below shoulders 33 on the central rib. Also, each of ribs 35 and 36 adjacent its upper end defines a lip 37 which extends toward, but not to, the lip on the other rib. Ribs 35 and 36 are parallel to each other and to the central rib and extend along the top flange of support member 18 over essentially the entire length of the support member. Accordingly, ribs 35 and 36 and lips 37 thereof cooperate to define a recess 38 between them, the recess being wider at its bottom than it is at its opening between lips 37. Ribs 30, 35 and 36 preferably are formed integral with support member 18 by an extrusion process.

An elongate, deformable, resilient, and preferably elastomeric gasket member 40 is disposed in each recess 38 along the entire length of the recess and has the major portion of its cross-sectional area disposed above and supported by the upper extents of ribs 35 and 36. As shown best in FIG. 2, the gasket member above recess 38 has a cross-sectional configuration generally resembling that of a truncated triangle or trapezoid. The portion of the gasket member which lies within the recess has a cross-sectional configuration generally resembling an inverted T which has a profile closely conforming to the cross-sectional configuration of recess 38 as defined by ribs 35 and 36 and lips 37 thereof. Accordingly, the base of the gasket member is held captive in recess 38 for positioning the gasket member on support member 18. The upper extent of the gasket member preferably lies at a location to the side of but below the upper end 32 of central rib 30.

As noted above, in the presently preferred usage of this invention, closure panel 20 is provided as a transparent glazing panel. More specifically, the closure panel preferably is a glazing panel having an outer sheet 44 and an inner sheet 45 disposed in spaced parallel relation to each other and secured in that relation by a spacer member 46 bonded between a bottom surface of the outer sheet and a top surface of the inner sheet along the margin of those sheets adjacent preferably aligned edges 47 of sheets 44 and 45. Inasmuch as glazing panel 20 is provided for closing the triangular openings in dome module 10, the glazing panel is substantially triangular in plan configuration, but is truncated or cropped slightly at its corners in the manner represented at 74 in FIG. 4 to facilitate sealing of the corners of the glazing panel to the structure of a hub assembly at corresponding ones of hub points 19 of the dome module. In any event, a spacer 46 is provided between the opposing edge margins of the upper and lower sheets of the glazing panel around the entire periphery of the panel, so that a space 48 is defined between sheets 44 and 45 ad is entirely closed around its perimeter by the spacers. FIG. 2 shows that, preferably, lower sheet 45 of the glazing panel is defined by a sheet of safety glass comprised of individual relatively thin glass sheets 49 and 50 laminated to a central, tough, transparent film 51. Either or both or neither of sheets 44 and 45 can be defined by safety glass.

Each spacer 46 of glazing panel 20 preferably is defined as a metallic, preferably aluminum extrusion having a cross-sectional configuration which defines an outwardly facing recess 53 along its length, and also an inwardly facing recess 54 along its length. A quantity of a desiccant material 55 preferably is disposed in recess 54 of the spacer to absorb and retain any moisture present in the air trapped in space 48 in the course of manufacture of the glazing panel. The cross-sectional contour of the spacer recess 54 can be any configuration desired and effective.

In the practice of this invention, at least that boundary of the opening into spacer recess 53 which lies farthest from upper glazing panel 44 is defined by a lip 57; preferably both of the edges of the opening into recess 53 are defined by such lips. Accordingly, the opening of the recess is constricted relative to its interior volume for reasons which will become apparent in the following description.

In the course of assembling the connection joint between closure panel 20 and a support member 18, the closure panel is placed in its desired position in the structure of which support member 18 is a component. As so placed, the bottom surface of bottom glazing sheet 45 is placed in contact adjacent its edge 47 with the upper portions of the gasket members 40 carried by the several support members to which the closure panel is to be mounted and by which it is to be supported. As so placed, the edges 47 of the closure panel are positioned between the pertinent gasket member and the adjacent central ribs 30 carried by the respective support members. The closure panel is then mechanically secured in a weathertight manner in its as-placed position by engaging respective ones of a plurality of hold-down retainer clips 60 between the closure panel and the corresponding support members at appropriate locations along each edge of the closure panel.

As shown in FIG. 2, each hold-down retainer clip 60 is defined as a length of spring metal of appropriate dimensions, bent at appropriate places in appropriate directions along its length to cooperate over the lower lip 57 of spacer recess 53 and with the adjacent shoulder 33 on support member central rib 30 for forcibly holding the closure panel 20 in sealing cooperation with gasket member 40. Accordingly, an upper end portion of each clip 60 defines a hook configuration 61 for engaging over spacer lip 47 along the lower portion of the opening of spacer recess 53. Adjacent its other end, the clip material is bent to define a return bend 62, from which the clip material extends to an end 63. The configuration and dimensions of the clip member, as formed, are selected so that the distance between return bend 62 and end 63 is such that, when the clip member is forced into position with its hook configuration 61 engaged on spacer lip 47 and its end 63 thereof bearing against shoulder 33 of support member central rib 30, the material of the clip at return bend 62 bears against the surface of rib 35 which faces toward central rib 30 and the portion of the clip defined between return bend 62 and end 63 cannot thereafter pivot about end 63 because of interference of the return bend with the adjacent surface of rib 35.

Once the closure panel has been put in its desired position in engagement with gasket members 40, a suitable number of hold-down retainer clips 60 can be engaged between the edges of the panel and the support members at roughly regular intervals along each edge of the panel. The clips provide the requisite sealing engagement of the closure panel against the gasket member. Thus, the cooperating features of the connection are dimensionally interrelated so that retainer clips 60 cannot be engaged in a desired manner between the closure member and shoulders 33 unless and until the gasket members deform sufficiently to provide a watertight and airtight seal between them and the adjacent portions of the closure panel. Each of the hold-down retainer clips can be put into the desired engaged relation between the closure panel and the support member by pushing the clip into the desired position. This can be done by the use of a screwdriver or the like engaged in the interior of return bend 62, so that the return bend portion of the clip can be passed through the space between panel edge 47 and support member central rib 30, after which the clip opens to cause clip end 63 to bear against the adjacent shoulder 33.

It will be apparent from the preceding description that support member 18 carries a pair of gaskets 40 for cooperating with the lower edge margins of respective ones of a pair of closure panels 20. When the two closure panels to be supported by support member 18 have been mechanically secured in position on the support member through the use of suitable numbers of clips 60, there remains a space between the adjacent edges 47 of the two closure panels above central rib 30. This space is closed by the use of a deformable backer strip 65 fitted into opposing spacer recesses 53 in the upper portions of those recesses to bridge the space between the opposing closure panels. This is shown in FIG. 2. The backer 65 can be provided as a strip of polyethylene foam, for example, of appropriate width and thickness, the width being greater than the distance between opposing panel edges 47 by about twice the depth of each spacer recess 53. As engaged in the opposing recesses 53, the backer 65 preferably lies below a plane between lines of intersection between the outer surfaces of the closure panels and their edges 47. A suitable quantity of a mastic-like sealing material 67 is applied over the top of backer 65 to bond to the backer and to the adjacent edges of the closure panel, and to define a surface 68 which is essentially smooth to the outer surfaces of the closure panels bridged by the sealing material. A suitable sealing material is a silicone rubber which is applied in a thick paste-like consistency, but which cures upon exposure to air to a somewhat harder, but not fully hard, elastic and resilient condition and which also bonds to the surfaces with which it is in contact. The installation of a backer 65 in the space between adjacent closure panels 20 as mounted to support member 18, and the application of sealing material 67 over the top of the backer in a bonding manner to the adjacent edges of the closure panels completes the assembly of the connection. The result is a mechanically secure, weathertight, and relatively flexible connection of each closure panel to its supporting member via an arrangement which provides an essentially flush surface between the outer surfaces of the adjacent closure panels. The connection has inherent accommodation for expansion or contraction of the glazing panel relative to the support member, and for deflection of the glazing panel. Such accommodation is provided by the flexibility of clips 60, backer 65 and the sealing material which can deflect as the panel pivots slightly on or slides on gasket member 40.

FIGS. 3 and 4 show an exemplary hub assembly 70 at one of hub points 19 within the interior of dome module 10. At each hub point, an upper 71 and a lower 72 hub plate can be bolted to the top and bottom flanges 26 and 27 of the several support members 18 associated with the hub point. To facilitate bolting of the top hub plate 71 to the top flanges 26 of the several support members via the top surfaces 31 of those support members, the central rib 30, ribs 35 and 36, and gasket member 40 carried by each support member are terminated a selected distance inwardly from each end of the respective support member. The top hub plate 71 then can be bolted to a flat or substantially flat top surface of the support member. A hub backer 65' of generally circular shape, rather than elongate strip-like shape, but otherwise similar to backer 65 described above is engaged in the recesses 53 of the spacer associated with each cropped corner 74 of the several closure panels associated with the hub point. This is shown in FIG. 3. Thereafter a suitable quantity of sealing agent 67 is applied, as by trowelling, over the top of backer 65' to cooperate with the adjacent edges of the several closure panels and with the sealing agent applied over the top of the backers 65 between adjacent closure panels in the manner described above.

FIG. 5 is a cross-section view similar to that of FIG. 2 showing a connection according to this invention between a support member 18' and a closure member 20'. Support member 18' is similar to support member 18 described above except that, at the intersection of its web 25 with its top flange 26 and with its bottom flange (not shown), support member 18' a circular passage 75. Passage 75 can be tapped at the ends of the support member to enable the support member to be used with a cup-like hub member of the kind shown in FIG. 8, for example, of my prior U.S. Pat. No. 3,916,589 if that form of hub assembly is desired at each of hub points 19 in dome module 10.

FIG. 5 also shows that closure panel 20' is a singly glazed closure panel rather than the doubly glazed closure panel shown in FIG. 2, for example. Accordingly closure panel 20' is comprised of a single sheet of glass or transparent plastic 72 carrying on its lower surface adjacent its edge 47 a mounting member 46' which defines features 53 and 57 along its outer face in the manner in which those features are found in spacer 46 of doubly glazed closure panel 20'. Mounting member 46' provides recess 53 with lower boundary lip 57 and also a bearing surface 73 in spaced relation to the top surface of the closure panel for cooperation with gasket 40 as carried by support member 18'. Hold-down clips 60 configured as described above are usable in the manner described to secure the closure panel to gasket 40 in a mechanically secure and weathertight manner.

Figure 6:
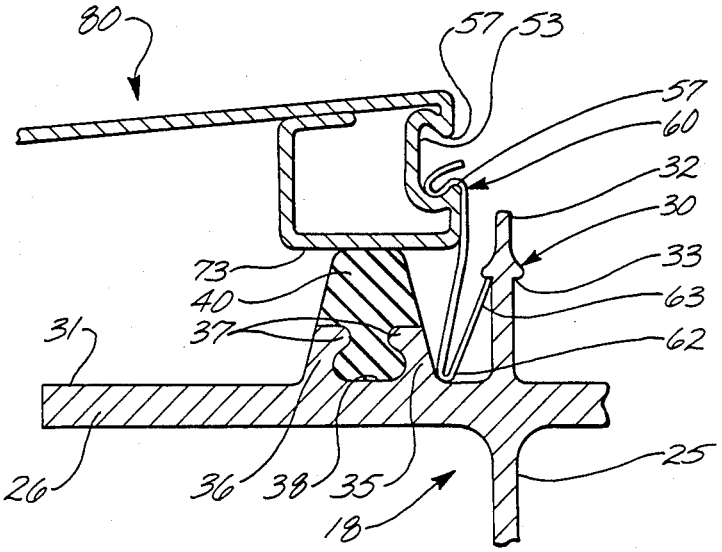
FIG. 6 is a fragmentary cross-sectional elevation view, similar to FIGS. 2 and 5, showing the use of the present joint to mount a metal sheet to a support member in a weathertight and mechanically secure manner.

FIG. 6 is a cross-sectional elevation view similar to that of FIG. 2 through a support member 18 complying with the preceding descriptions. FIG. 6 shows how an opaque sheet metal closure panel 80 can be mounted to the support member through the agency of hold-down retainer clips 60 and the above-described other features and principles of this invention. In this instance, the metal closure panel defines along each side edge thereof a recess 53 having a side facing opening bounded by lips 57. This structure along the edge margin of the closure panel also defines a mounting surface 73 for cooperation with an adjacent gasket member 40. Recess 53 and mounting surface 73 can be defined integrally with the panel by suitably bending the material of the closure panel along its edge margins in an appropriate manner. Alternatively, suitable structure defining the recess and mounting surface can be affixed to the metal closure panel in any way desired, as by spot welding.

In the preferred practice of this invention there is a single recess 53 defined along the entire extent of each panel edge associated with a support member. This is preferred because the preferred type of spacer used with a transparent or translucent panel is an extrusion. It will be recognized, however, that plural recesses 53', each of short length along the panel, can be provided in the side face of a spacer 46'' at intervals along the spacer. Conversely, a single elongate clip, dimensioned to extend along an entire panel edge, can be used in place of plural short clips 61 engaged between the support member and the panel at intervals along the panel edge. Similarly, especially if a support member 18'' is not an extrusion, shoulders 33' can be provided at intervals along the support member for cooperation with either a single elongate clip member or a plurality of short clips 61. The discontinuous recess and shoulder variation on the structures described above is shown in FIG. 7 which is similar to an elevation view looking left at the right side of FIG. 5.

A panel mounting according to this invention secures the panel in place in a weathertight manner by pulling it into sealing relation with a resilient gasket in such a way that the panel can experience limited translational and angular motions at its margins due to thermal effects and applied loads. Any stresses developed in the panel are accommodated, rather than increased by such motions. This means that, where the panel is a glass or plastic panel, its mounting does not aggravate the effects of stresses developed in the panel, and so the mounting minimizes the potential for the development of panel stresses sufficient to cause the panel to fracture or break. Also, the mounting is one which can be installed or completed quickly and efficiently at the site. When the mounting is completed, those of its elements which provide the mechanical connection of the panel to the support member are protected from external environmental influences, and so they do not degrade or corrode or weather as they might were they more exposed. If a mounted panel should ever require replacement or repair, the mounting can be opened by cutting the sealing material with a sharp knife along the adjacent panel edge 47 and removing the necessary sealing material and backer 65 from the connection, thus to expose clips 60 which can be removed by disengaging their ends 63 from shoulders 33 through use of a suitable tool. Any clips significantly deformed by such removal can be replaced rather than reused. Installation of a new panel can then be completed quickly in the manner described above.

From the preceding descriptions it will be seen that this invention provides effective and efficient structural arrangements and procedures for mounting glazing panels and opaque panels to supporting members in a secure and weather-tight joint. The structure of the completed joint provides a flush surface between outer surfaces of adjacent panels mounted to a common support member, thereby fulfilling the need described above. The arrangements and procedures described above include a presently preferred structural arrangement and procedure for providing the present mounting as well as other arrangements and procedures. The preceding descriptions are of illustrative arrangements of the invention and do not constitute an exhaustive catalog of all forms of the structural and procedural embodiments of this invention. Workers skilled in the art to which this invention pertains will appreciate that variations from or modifications in the arrangements described above can be practiced to use the principles and advances provided by this invention and without departing from the scope of the invention. Accordingly, the following claims are to be read in this context and are to be given the broadest construction and interpretation which is properly affordable to them by this invention and the place it occupies in the relevant technology.

What is claimed is:

1. A joint for connecting a sheet of material to a support member having an outer surface, the joint comprising means located along an edge margin of the sheet away from a sheet outer surface and defining at least at each of several places therealong a recess disposed substantially parallel to the edge margin and facing laterally away from a central part of the sheet, means extending from the support member outer surface defining shoulder means at least at each of several places along the support member adjacent a desired connected position of the sheet, the shoulder means being located outwardly from the support member outer surface and facing toward the support member, resilient gasket means carried by the support member outer surface along the length of the member at a location on the member within said desired position, and resilient clip means configured at one end thereof to forcibly engage in a recess and configured at the other end to forcibly engage a shoulder means, each clip means being dimensioned and configured intermediate its ends adequately that, upon placement of the sheet in the desired position and upon engagement as aforesaid of the clip means with the recess and shoulder means, the clip means forcibly urges the sheet into sealing contact with the gasket means and holds the sheet in the desired position.

2. A joint according to claim 1 wherein the components of the joint are configured and dimensioned cooperatively and sufficiently that the recess is disposed outwardly of the shoulder means relative to the support member outer surface and the clip means pull the sheet into sealing contact with the gasket means upon assembly of the joint.

3. A joint according to claim 1 wherein the components of the joint are configured and dimensioned so that, upon assembly of the joint, no component extends beyond the sheet outer surface.

4. A joint according to claim 1 wherein the recess is defined to extend substantially continuously along the sheet edge margin.

5. A joint according to claim 1 wherein each recess is defined to have a lip along the side of the recess opening which is disposed away from the sheet outer surface.

6. A joint according to claim 5 wherein the clip means is defined to engage in a recess over the lip.

7. A joint according to claim 1 wherein the shoulder means is defined to extend substantially continuously along the support member adjacent said desired position.

8. A joint according to claim 7 wherein the shoulder means is defined along a rib extending from the support member and extending along the support member adjacent said desired position.

9. A joint according to claim 1 wherein the sheet is a translucent sheet, and the means defining the recess comprises a member affixed to the sheet along a margin of an inner surface of the sheet.

10. A joint according to claim 1 including a quantity of sealing material bonded to the sheet edge and extending away therefrom substantially flush with the sheet outer surface.

11. A joint according to claim 10 including a member disposed in the recess and outwardly therefrom and over which the sealing material is disposed.

12. A joint according to claim 1 wherein there is adjacent the sheet edge margin a single recess which extends continuously along the means in which it is defined.

13. A joint according to claim 1 wherein the clip means is cooperable with the recess and the shoulder means for pulling the sheet into contact with the gasket means

14. A joint for connecting of a sheet of material to a support member having a top surface, the joint comprising means extending along an edge margin of an inner surface of the sheet adjacent the sheet edge and defining a recess which extends substantially parallel to the edge margin substantially along the extent of the edge margin, the recess facing laterally away from a central part of the sheet and having an opening bounded along a side thereof disposed away from the sheet by a lip, a rib upstanding from the support member top surface along substantially the length of the member to which the sheet is to be connected in a desired position, the rib defining downwardly facing shoulder means on the side of the rib adjacent said desired position, resilient gasket means carried by the support member top surface substantially parallel to the rib substantially along the length of the member at a location on the member within said desired position, and resilient clip means configured at one end thereof to forcibly engage in the recess over the lip and configured at the other end to forcibly engage the rib shoulder means, the clip means being dimensioned and configured intermediate its ends adequately that, upon placement of the sheet in the desired position and engagement of the clip means with the recess and the rib shoulder means, the clip means forcibly urges the sheet into sealing contact with the gasket means and holds the sheet in the desired position.

15. A joint according to claim 14 including additional rib means carried by the support member top surface for carrying the gasket means, and wherein the clip means is configured intermediate its ends to engage the support member top surface between the rib and the additional rib means.

16. A joint according to claim 14 for connecting the edge margins of a pair of sheets to the support member, each sheet carrying recess defining means along an inner edge margin thereof, the rib being disposed on the support member centrally between the desired positions of the sheets relative to the support member, the rib defining shoulder means along each side thereof, and a second gasket means on the support member, the rib being disposed substantially centrally of the two gasket means.

17. A joint according to claim 16 wherein the joint components are defined so that, when the sheets are disposed in said desired positions in sealing contact with the gasket means, the rib has an upper end not substantially above the recesses.

18. A joint according to claim 17 including backing means for engagement between the recesses across the top of the rib and for supporting a sealing material applicable thereover and between the adjacent edges of the sheets.

19. A method for mounting a sheet to a support member, the sheet and the support member each having an outer surface, the sheet outer surface extending substantially flush to a sheet edge, the method comprising the steps of contacting the sheet adjacent said edge with resilient gasket means carried by the support member outer surface via mounting means carried by the sheet along an inner surface of the sheet adjacent the sheet edge and defining a recess opening away from a central part of the sheet between the sheet outer surface and the support member, engaging, between the recess and means carried by the support member inwardly of the sheet outer surface toward the support member, resilient means for making said contact with the gasket means sufficiently forcefully to produce a seal against the gasket means, and applying to the sheet edge and essentially flush with the sheet outer surface a sealing material which bonds to the sheet and extends away therefrom.

20. A method for mechanically mounting a sheet to a support member comprising the steps of providing on the support member within a desired mounted position of the sheet to the support member a gasket element which extends along and adjacent to a mounted edge of the sheet, providing mounting means on the sheet along a sheet inner surface adjacent said edge which define a recess opening laterally away from a central part of the sheet inwardly from a sheet outer surface, providing on the support member adjacently outside said mounted position of the sheet, and inwardly of the sheet outer surface in the mounted position of the sheet, a shoulder which opens toward the gasket element and the support member, placing the sheet in the desired mounted position in contact with the gasket element and with the sheet inner surface toward the support member, and engaging between the recess and the shoulder a resilient member which urges the sheet forcefully into contact with the gasket element and which is disposed inwardly of the sheet outer surface when so engaged.

21. The method according to claim 20 including providing the shoulder substantially continuously along the mounted position of the sheet.

22. The method according to claim 20 including providing the recess substantially continuously along and adjacent to the sheet edge.

23. The method according to claim 20 including providing the shoulder and the recess substantially continuously along and adjacent to the sheet edge, and including engaging a plurality of said resilient members between the shoulder and the recess at intervals along the sheet edge.

24. The method according to claim 20 as practiced for mounting two sheets to the support member in proximate, spaced, adjacent mounted positions including performing the providing steps, the placing step, and the engaging step as set forth in claim 18 for each of the sheets, and further including disposing space closure means in the space between the mounting sheets substantially flush with the outer surfaces of the sheets.

25. The method according to claim 24 wherein the disposing step includes applying a sealing material between the adjacent sheet edges.

26. A mounting of a sheet of material to a support member at an edge margin of the sheet, comprising mounting means connected to the sheet and extending away from an inner surface of the sheet adjacent the sheet edge associated with the sheet edge margin and defining a recess which opens away from a central part of the sheet, a resilient gasket element carried by the support member within a mounted position of the edge of the mounted sheet, a shoulder element carried by the support member outside and adjacent to the mounted position of the sheet and defining a shoulder which faces toward the gasket element and the support member, and a resilient sheet holder member configured for forcible engagement thereof with the recess and the shoulder to forcibly urge the sheet, when disposed in its mounted position relative to the support member, into contact with the gasket element, the mounting means, the shoulder element and the holder member being defined in relation to each other so that no portion of any of them is disposed outwardly of an outer surface of the sheet from the support member upon engagement of the holder member.

27. A mounting of a sheet of material to a support member at an edge margin of the sheet, comprising mounting means connected to the sheet and extending away from an inner surface of the sheet adjacent the sheet edge associated with the sheet edge margin and defining a recess which opens away from a central part of the sheet, a resilient gasket element carried by the support member within a mounted position of the sheet and which extends along and adjacent the position of the edge of the mounted sheet, a resilient sheet holder member captive between the support member and the mounting means in engagement with the recess biasing the sheet into engagement with the gasket element, the mounting means, the holder member and the support member being defined in relation to each other so that they all are disposed inwardly of an imaginary extension of an outer surface of the sheet beyond the sheet edge.

28. A mounting according to claim 27 in which the holder member is disengageable from the recess for disconnection of the mounting.

29. A mounting according to claim 27 including a holder member contact surface carried by the support member adjacent the mounted position of the sheet, the holder member being captive in the mounting between the recess and the contact surface.

30. A mounting according to claim 29 in which the holder member is configured to engage the support member at the contact surface and at an additional location on the support member.

* * * * *